United States Patent [19]

Davis

[11] Patent Number: 4,640,372

[45] Date of Patent: Feb. 3, 1987

[54] DIVERTER INCLUDING APPARATUS FOR BREAKING UP LARGE PIECES OF FORMATION CARRIED TO THE SURFACE BY THE DRILLING MUD

[76] Inventor: Haggai D. Davis, 1910 McDermott Dr., Morgan City, La. 70380

[21] Appl. No.: 801,294

[22] Filed: Nov. 25, 1985

[51] Int. Cl.[4] ..... E21B 21/06

[52] U.S. Cl. ..... 175/208; 166/82; 166/90; 175/209; 175/214; 175/422 R

[58] Field of Search ..... 175/207–210, 175/214, 218, 84, 422 R; 166/75.1, 82, 84, 88, 90

[56] References Cited

U.S. PATENT DOCUMENTS

| | | | |
|---|---|---|---|
| 1,521,390 | 12/1924 | Reynolds | 166/90 |
| 3,943,997 | 3/1976 | Davis | 166/312 |
| 4,279,300 | 7/1981 | Wirsch | 166/90 |
| 4,456,062 | 6/1984 | Roche et al. | 166/88 |

*Primary Examiner*—Stephen J. Novosad

*Assistant Examiner*—Hoang C. Dang

*Attorney, Agent, or Firm*—Vaden, Eickenroht, Thompson & Boulware

[57] ABSTRACT

A diverter for drilling mud is disclosed that has a packer housing mounted on the upper end of a riser through which drilling mud flows to the surface between the riser and the pipe string extending through the riser. A packer having a body of resilient material is located in the housing. Fluid pressure moves the body of resilient material into sealing engagement with the pipe string to divert drilling fluid laterally into a mud return line. A plurality of conduits extend vertically through the packer. Each conduit includes a flexible section extending through the body of resilient material to move with the resilient material as it is moved into and out of sealing engagement with the pipe string. Drilling mud is pumped through the conduits and nozzles attached to the lower ends of the conduits. The nozzles are positioned to divert the drilling fluid into the drilling fluid below the packer to break up large pieces of formation carried to the surface by the drilling mud.

3 Claims, 4 Drawing Figures

FIG. 2
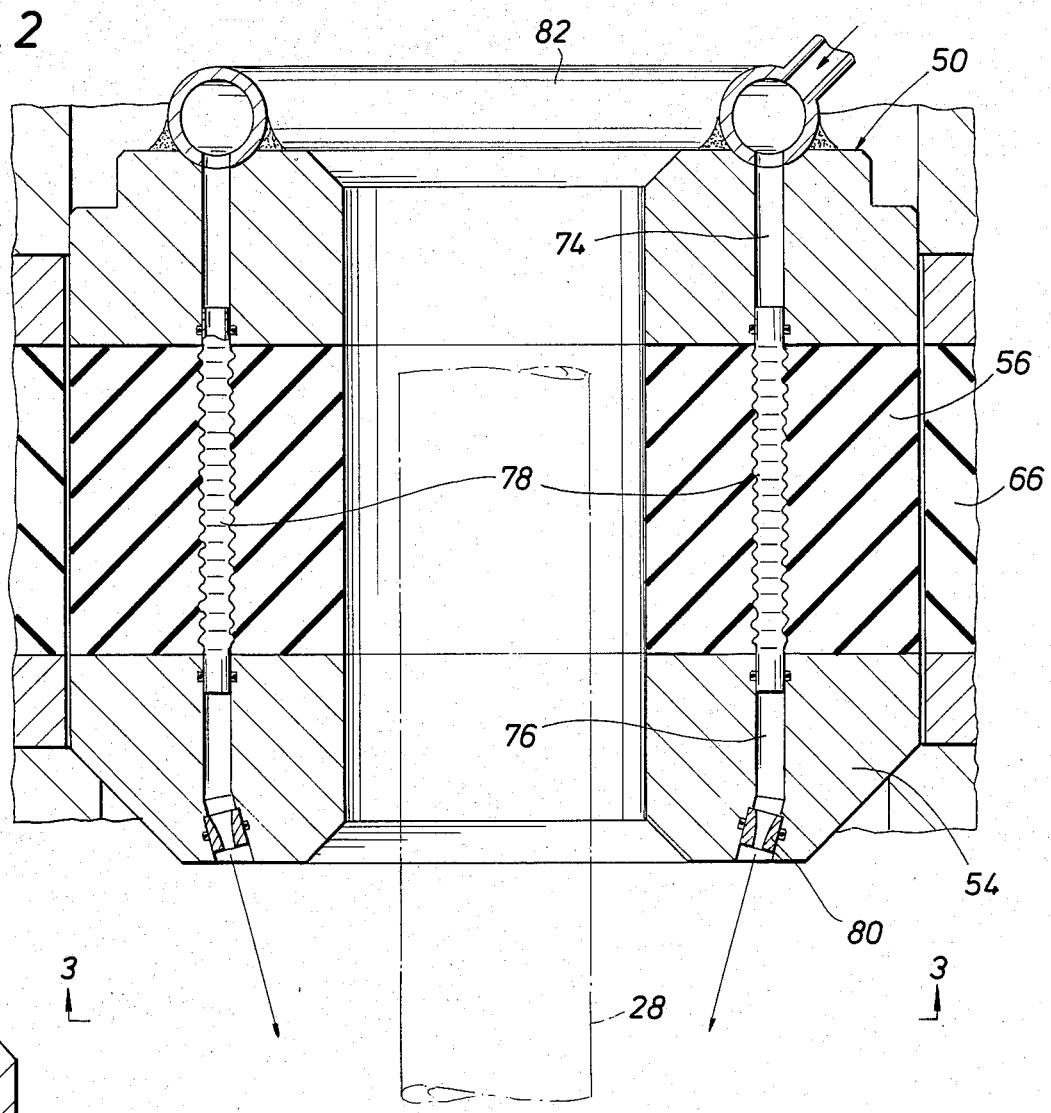
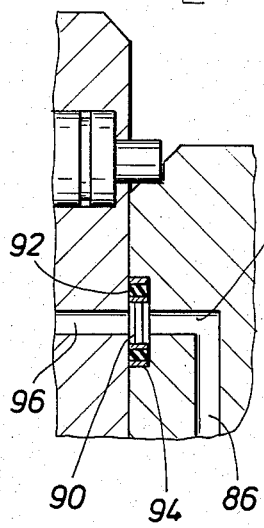
FIG. 4
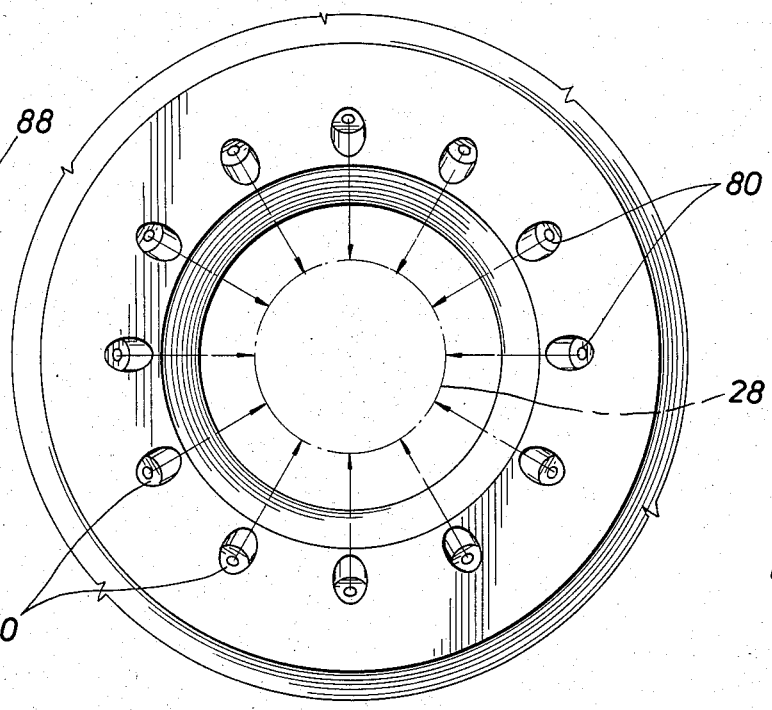
FIG. 3

DIVERTER INCLUDING APPARATUS FOR BREAKING UP LARGE PIECES OF FORMATION CARRIED TO THE SURFACE BY THE DRILLING MUD

This invention relates to diverters used to divert drilling fluid into the mud return line when a kick occurs.

Diverters are most commonly used in offshore drilling where a riser, including a telescoping joint, is suspended from the beams that support the rotary table on the floor of the drilling rig. The purpose of the diverter is to keep drilling mud from being blown upwardly through the rotary table by gas pressure when a kick occurs by diverting the drilling mud laterally into the mud return line. To accomplish this, the diverter is located in the riser assembly just above the connection between the mud return line and the riser assembly and includes a packing element that closes the annulus between the drill string and the diverter housing above the mud return line.

In my U.S. Pat. No. 3,943,997, which issued Mar. 16, 1976 and is entitled "Rotary Drilling Apparatus and Method", an apparatus for and a method of breaking up large pieces of formation that are carried to the surface by the drilling mud is described. This problem occurs in various parts of the world and, in particular, in the Gulf Coast area where most wells have to pass through a formation called "gumbo" that will break off in large chunks and move to the surface with the drilling mud where it will often plug up the mud return line to the extent that drilling has to be stopped until the gumbo is cleaned out of the line manually.

The apparatus disclosed in my patent includes a plurality of nozzles located in the bell nipple to direct a plurality of streams of drilling mud against the surface of the drilling mud in the bell nipple to break up the pieces of gumbo as they reach the surface into pieces small enough to flow laterally through the mud return line without plugging it up. When a diverter is used, it is located where the nozzles of the apparatus disclosed in the patent are usually located. Preferably, the nozzles should be located on the lower side of the packing element, but this presents the problem of supplying the nozzles with drilling mud through the body of elastomeric material that is compressed into sealing engagement with the drill string.

Therefore, it is an object of this invention to provide a packing element for a diverter that has a plurality of passageways through the packing element with each passageway including a flexible section located in the body of resilient, elastomeric material that can move laterally with the elastomeric material as it is moved into and out of sealing engagement with the drill string while allowing drilling mud to be pumped through the conduits to the nozzles positioned in the bottom of the packing element to direct the mud against the surface of the mud in the riser.

This and other objects, advantages, and features of this invention will be apparent to those skilled in the art from a consideration of this specification, including the attached drawings and appended claims.

IN THE DRAWINGS

FIG. 2 is a sectional view on an enlarged scale of the diverter of the riser assembly of FIG. 1 with the packing element relaxed;

FIG. 3 is a view looking in the direction of arrows 3—3 in FIG. 2; and

FIG. 4 is an alternate arrangement for supplying the nozzles with drilling mud.

Figure 1:
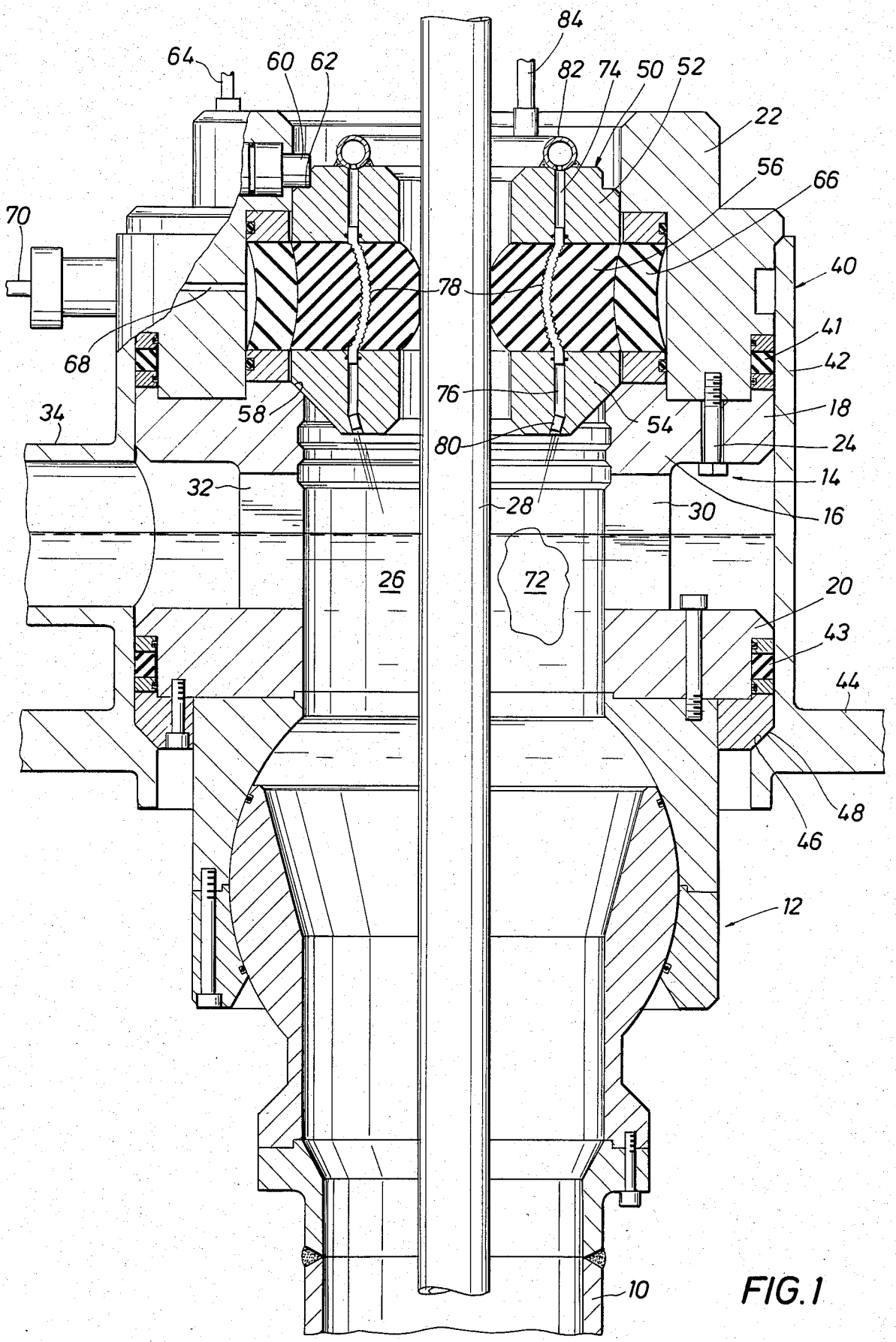
FIG. 1 is a vertical sectional view through a diverter located on the upper end of a typical riser assembly with the packing element in sealing engagement with the drill string.

The portion of the riser assembly shown in the drawings includes upper end 10 of the riser itself, which may be part of a telescoping joint. Connected to the top of riser 10 is ball joint assembly 12, which allows some pivotal movement between the riser and diverter 14. The diverter includes spool shaped member 16 having upper and lower annular flanges 18 and 20. The diverter also includes packer housing 22 that is connected to the spool portion by a plurality of mounting screws 24. Drill string 28 extends through central opening 26 through which drill pipe 28 extends. The diverter along with ball joint 12 and riser 10 are supported below the rotary table (not shown) by housing 40. The housing includes tubular section 42 and support flange 44 connected to tubular section 42 at its lower end. Flange 44 is attached to the rotary beams below the rotary table by support rods (not shown) to transfer the weight of the riser assembly to the rotary beams. The diverter is supported in the housing and transfers its weight and that of the riser to the housing through engaging shoulders 46 and 48 on the lower end of the housing and the diverter.

When drilling, mud is pumped down through drill pipe 28 and returns to the surface through the annulus between the drill pipe and the riser assembly. When it reaches the lower portion of opening 26 in the diverter, it flows laterally through openings 30 and 32 into the annulus between the diverter and housing 40. Seals 41 and 43 confine the mud to the annulus from where it flows through flow line 34 to the shell shaker and the mud tanks to be pumped again down through the drill pipe. Packer 50 is located in the upper end of the diverter to close off the annulus between the drill pipe and the opening through the diverter when a kick is expected to keep drilling mud from being blown up through the rotary table and on to the floor of the drilling rig by the gas. The packer includes upper and lower rigid packer retaining plates 52 and 54 between which is sandwiched packing element 56 of resilient material, such as rubber. The packing element is supported in the diverter by shoulder 58 on the upper end of spool 16. Latching pin 60 that engages upwardly facing shoulder 62 on the upper end of the packer, holds the packer against the force of the upwardly flowing mud during a kick. Latch pin 60 is held in locking position by fluid pressure supplied through line 64 and is moved to the left, as viewed in FIG. 1, to release the packer by a spring (not shown) when the pressure in line 64 is released.

Packing element 56 is compressed and forced inwardly into engagement with the drill pipe by fluid pressure acting against annular resilient ring 66 mounted on the inside wall of packer housing 22. The fluid pressure is supplied through port 68 and line 70.

In accordance with this invention, packer 52 of the diverter includes apparatus for breaking up large pieces of formation that are carried to the surface by the drilling fluid. Such large pieces of formation are indicated in FIG. 1 by the number 72. In the embodiment shown, upper retaining plate 52 is provided with a plurality of passageways 74 that extend through the plate and are in a vertical alignment with a plurality of passageways 76 that extend through lower retaining plate 54. Connecting these passageways are a plurality of flexible conduit sections 78 that extend through packing element 56 and into the adjacent ends of passageways 74 and 76. The flexible conduit sections are positioned in the packing element when it is molded. Seals 75 keep mud from escaping from the passageways. Nozzles 80 are positioned in the lower end of passageway 76 in the lower flange and are inclined to direct streams of mud pumped through the passageways against the upper surface of the drilling mud in the diverter to break up the chunks of gumbo as they reach and before they move laterally into flow line 34. Mud is supplied to the passageways through tubular member 82 that is attached to the upper retaining plate 52 and is connected to the upper end of each of passageway 74. The ring is supplied with drilling mud under pressure through conduit 84 in FIG. 1.

An alternate embodiment of the invention is shown in FIG. 4. Here instead of using the ring shaped tubular member attached to the top of the packer diverter, the upper retaining flange of the packer has vertical passageway 86 that connects with laterally extending passageway 88, which opens onto annular space 90 between packing rings 92 and 94. A permanent connection can then be made between the diverter housing and the diverter to supply drilling mud through passageway 96 into annular space 90 to supply the nozzles in the packer with drilling mud, while allowing the packer to be moved into and out of position in the diverter without having to connect and disconnect a mud line connection.

From the foregoing it will be seen that this invention is one well adapted to attain all of the ends and objects hereinabove set forth, together with other advantages that are obvious and that are inherent to the apparatus and structure.

It will be understood that certain features and subcombinations are of utility and may be employed without reference to other features and subcombinations. This is contemplated by and is within the scope of the claims.

Because may possible embodiments may be made of the invention without departing from the scope thereof, it is to be understood that all matter herein set forth or shown in the accompanying drawings is to be interpreted as illustrative and not in a limiting sense.

What is claimed is:

1. In a diverter for drilling mud having a packer-housing mounted on the upper end of a riser through which drilling mud flows to the surface between the riser and the pipe string extending through the riser and a packer located in the packer-housing, said packer having a body of resilient material, and means for moving the resilient material into sealing engagement with a pipe string to divert drilling fluid laterally into a mud return line, the improvement comprising a plurality of conduits extending vertically through the packer, each conduit including a flexible section extending through the body of resilient material to move with the resilient material as it is moved into and out of sealing engagement with the drill string, means supplying the upper ends of the conduits with drilling fluid, and nozzles located in the lower ends of the conduits to direct the drilling fluid into the drilling fluid below the packer.

2. The diverter of claim 1 in which the flexible sections of the conduits comprise metal hose.

3. The diverter of claim 1 in which the packer includes upper and lower packer retainer plates located on opposite sides of the body of resilient material and the conduits include passageways in the upper and lower retainer plates connected by the sections of flexible material extending through the packer.

* * * * *